US005775237A

United States Patent [19]

Reilly et al.

[11] Patent Number: 5,775,237

[45] Date of Patent: Jul. 7, 1998

[54] DRY BOTTOM ASH HANDLING SYSTEM

[75] Inventors: William P. Reilly, Dunellon, Fla.; John S. Tomaszek, Mundelein, Ill.

[73] Assignees: Florida Power Corporation, St. Petersburg, Fla.; United Conveyor Corporation, Waukegan, Ill.

[21] Appl. No.: 778,210

[22] Filed: Dec. 30, 1996

[51] Int. Cl.[6] ..... F23B 7/00

[52] U.S. Cl. ..... 110/234; 110/105; 110/106; 110/165 R; 110/251; 110/259; 432/78

[58] Field of Search ..... 432/78, 99; 110/251, 110/259, 104 B, 105, 106, 165 R, 234; 241/186.2, 185.6

[56] References Cited

U.S. PATENT DOCUMENTS

| | | | |
|---|---|---|---|
| 4,041,906 | 8/1977 | Edwards | 110/106 |
| 4,401,276 | 8/1983 | Arbie, Sr. | 241/29 |
| 4,655,404 | 4/1987 | Deklerow | 241/99 |
| 4,693,189 | 9/1987 | Powers | 110/105 |
| 4,728,288 | 3/1988 | Niems | 432/78 |
| 5,255,615 | 10/1993 | Magaldi | 110/234 |
| 5,406,747 | 4/1995 | Kiefl | 110/105 |
| 5,526,990 | 6/1996 | Chow et al. | 241/186.2 |
| 5,632,863 | 5/1997 | Meador | 201/25 |

*Primary Examiner*—Henry A. Bennett
*Assistant Examiner*—Jiping Lu
*Attorney, Agent, or Firm*—James E. Larson; Larson & Larson, P.A.

[57] ABSTRACT

A dry bottom ash handling system contemplates a plurality of hoppers disposed beneath a solid fuel-fired steam boiler. Each hopper includes angled walls converging at a generally rectangular opening controlled by a grate door. Air inlets are provided at intersections between adjacent angled walls to (1) facilitate combustion of unburned fuel in the storage hopper, and (2) facilitate flow of ash through the hopper opening. Ash flowing through the hopper opening enters a crusher and is then conveyed via a vacuum line to a point of disposal including a mobile tank truck that receives heavier ash particles and allows bypassing of lighter particles to a silo.

17 Claims, 7 Drawing Sheets

DRY BOTTOM ASH HANDLING SYSTEM

BACKGROUND OF THE INVENTION

The present invention relates to a dry bottom ash vacuum system. As mined, coal used to provide an energy source for a steam boiler contains varying quantities of mineral matter which, when the coal is burned, results in creation of the combustible residue known as ash. As is known, two types of ash result from operation of solid fuel-fired boilers, namely, bottom ash and fly ash. Bottom ash is slag that builds up on the heat absorbing surfaces of a furnace and that eventually falls by its own weight or as a result of load changes or the blowing of soot. Ash that becomes entrained with and is carried away by the flue gas stream is known as fly ash.

In the prior art, systems used to remove bottom ash from beneath a solid fuel-fired boiler generally fall into two categories; namely, wet or dry. The wet category consists of devices that employ a water filled tank to cool the ash and allow removal either mechanically or with a hydraulic conveying system. The dry category on boilers less than 100 MW utilizes a dry hopper that allows removal either manually or with a pneumatic conveying system. In each category, one goal is to limit or prevent introduction of ambient air into the boiler. Recently the dry category boiler size was increased to 500 Mw utilizing a mechanical belt conveying system and pneumatic system to convey ash to a point or disposal, with additional ambient air used to cool the belt.

Applicant is aware of U.S. Pat. No. 5,255,615 to Magaldi. Magaldi discloses a system for discharging bottom ash from steam-producing boilers that includes an ash hopper with a bottom discharge controlled by a gate valve. The present invention differs from the teachings of Magaldi as contemplating introduction of air into the hopper to promote combustion of combustible ash products as well as to best facilitate emptying of the hopper.

SUMMARY OF THE INVENTION

The present invention relates to a dry bottom ash handling system. The present invention includes the following interrelated objects, aspects and features:

(1) In a first aspect, contrary to the teachings of the prior art, the present invention intentionally permits the introduction of ambient air or air from another source into the hopper. Such air is introduced for two reasons, (a) to permit combustion of combustible ash products before disposal, and (b) to best facilitate conveyance of ash from the walls of the hopper down to the outlet thereof.

(2) In the preferred embodiment, each hopper is made of a multiplicity of angled walls extending from an enlarged opening above and converging together in a generally rectangular opening controlled by a gate valve. This configuration defines four seams extending from the upper opening to adjacent the bottom discharge opening.

(3) The air inlets are preferably disposed on the seams, described above, and are directed downwardly toward the bottom discharge opening and include nozzle structures that diverge in the direction away from the source of air so that air discharging through the openings spreads laterally to facilitate maintenance of clean ash-free surfaces in the hopper.

(4) Ash moves through the bottom discharge grate door of each hopper and enters the crusher where it is crushed. The crusher also serves to regulate the amount of ash delivered to a pneumatic conveyor.

(5) A screw feeder located beneath or behind the crusher serves to introduce the ash into the conveyor line. The use of a screw feeder significantly reduces the amount of head room required to accomplish this task.

(6) The ash is conveyed through the pneumatic conveyor system, first to a mobile vehicle having a tank interconnected into the pneumatic conveyor. Ash enters the tank through a pipe mounted on the front of the vehicle. The exit from the vehicle-mounted tank is also on the forward wall. In this way, the ash conveyed into the vehicle-mounted tank is subjected to reduction in conveying velocity because of the large difference in cross-sectional area between the conveyor and the tank. Thus, heavier particles remain within the tank whereas lighter airborne particles exit and are conveyed to a bottom ash silo and removed from the airstream via a filter/separator.

Accordingly, it is a first object of the present invention to provide a dry bottom ash handling system.

It is a further object of the present invention to provide such a system wherein a solid fuel-fired boiler has, mounted on the bottom thereof, a plurality of hoppers with each hopper having a plurality of air inlet ports therein.

It is a still further object of the present invention to provide such a system wherein the air inlet ports feed air into each hopper to promote combustion of combustible ash products as well as to keep the inner surfaces of the hopper clean.

It is still a further object of the present invention to use a crusher and a screw feeder in tandem to control the feed rate of ash into the pneumatic conveyor.

It is a yet further object of the present invention to provide such a system wherein a vehicle-mounted tank is interconnected into a pneumatic ash conveyance system in such a way that heavier ash particles are retained within the vehicle-mounted tank whereas lighter particles are conveyed to a downstream bottom ash silo.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
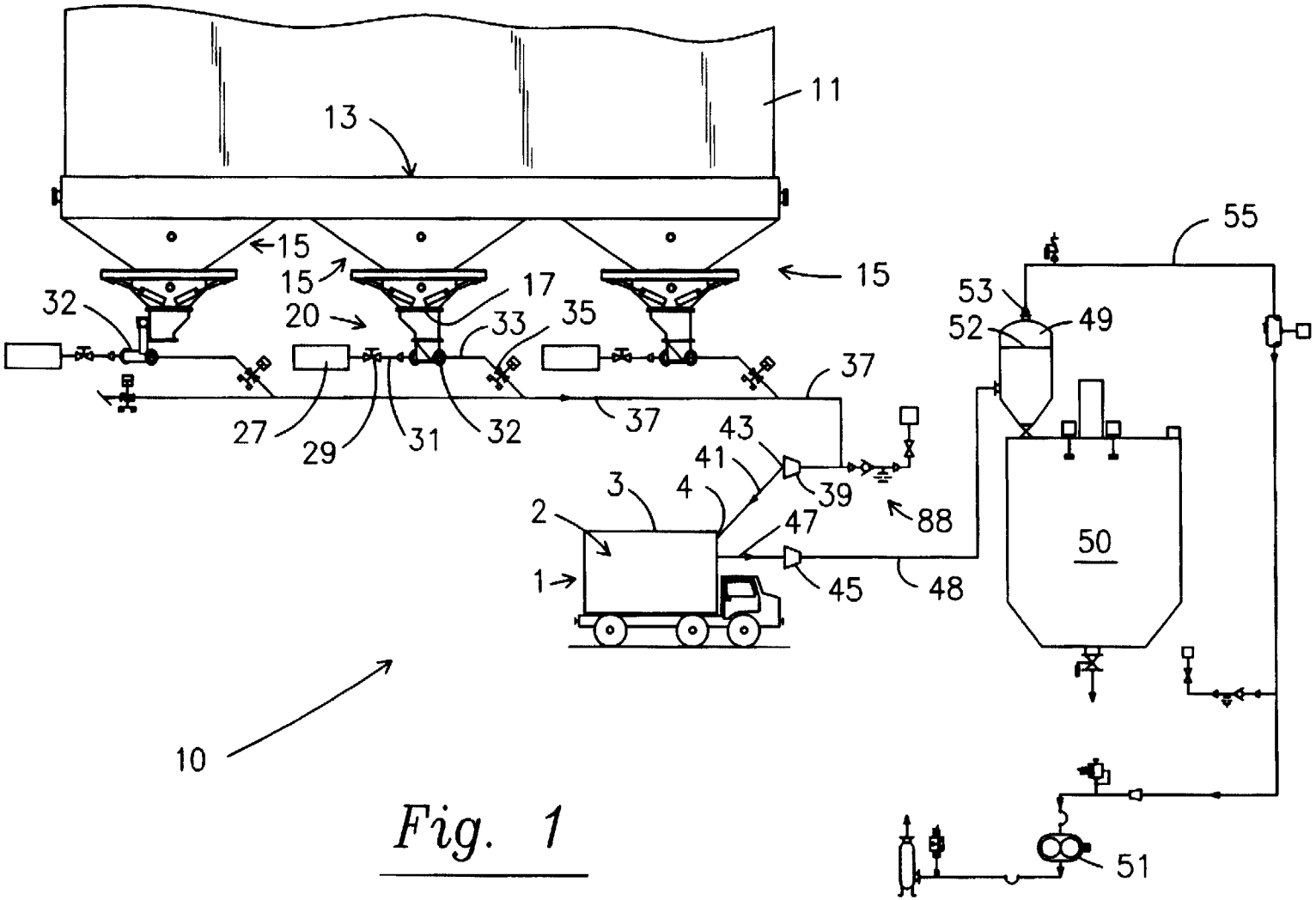
FIG. 1 shows a schematic representation of the inventive system.

With reference to FIG. 1, the inventive system is generally designated by the reference numeral 10 and is seen to include a boiler 11 having a bottom opening 13 to which is mounted a series of substantially identical hoppers, each of which is generally designated by the reference numeral 15. Each hopper has a bottom discharge 17 leading to a crusher mechanism 20 that crushes and comminutes and flow regulates ash particles passing therethrough and then leads them to a pneumatic conveyor generally designated by the reference numeral 25 and including a fan 27, a valve 29, a passageway 31 leading from the valve 29 to the bottom of the crusher 20, a further passageway 33 leading from the screw feeder assembly 32 of the crusher 20, a further valve 35 and a common pneumatic discharge line 37. As should be understood from FIG. 1, the common discharge line 37 receives comminuted ash from each of the hoppers 15 via each of the respective crushers 20. The common discharge line 37 leads to a first coupling 39 that is designed to receive an end 43 of a pipe 41 extending from the vehicle 1. A second coupling 45 is designed to receive a second pipe 47 extending from the vehicle 1 that also connects to a further conduit 48 leading to a bottom ash silo 50 via a filter/separator 49. As seen in FIG. 1, a pump 51 has its inlet side connected to the port 53 via the conduit 55 so that operation of the pump 51 in conjunction with the fans 27 maintains a vacuum at the port 53 that operates in conjunction with the fans 27.

Figure 2:
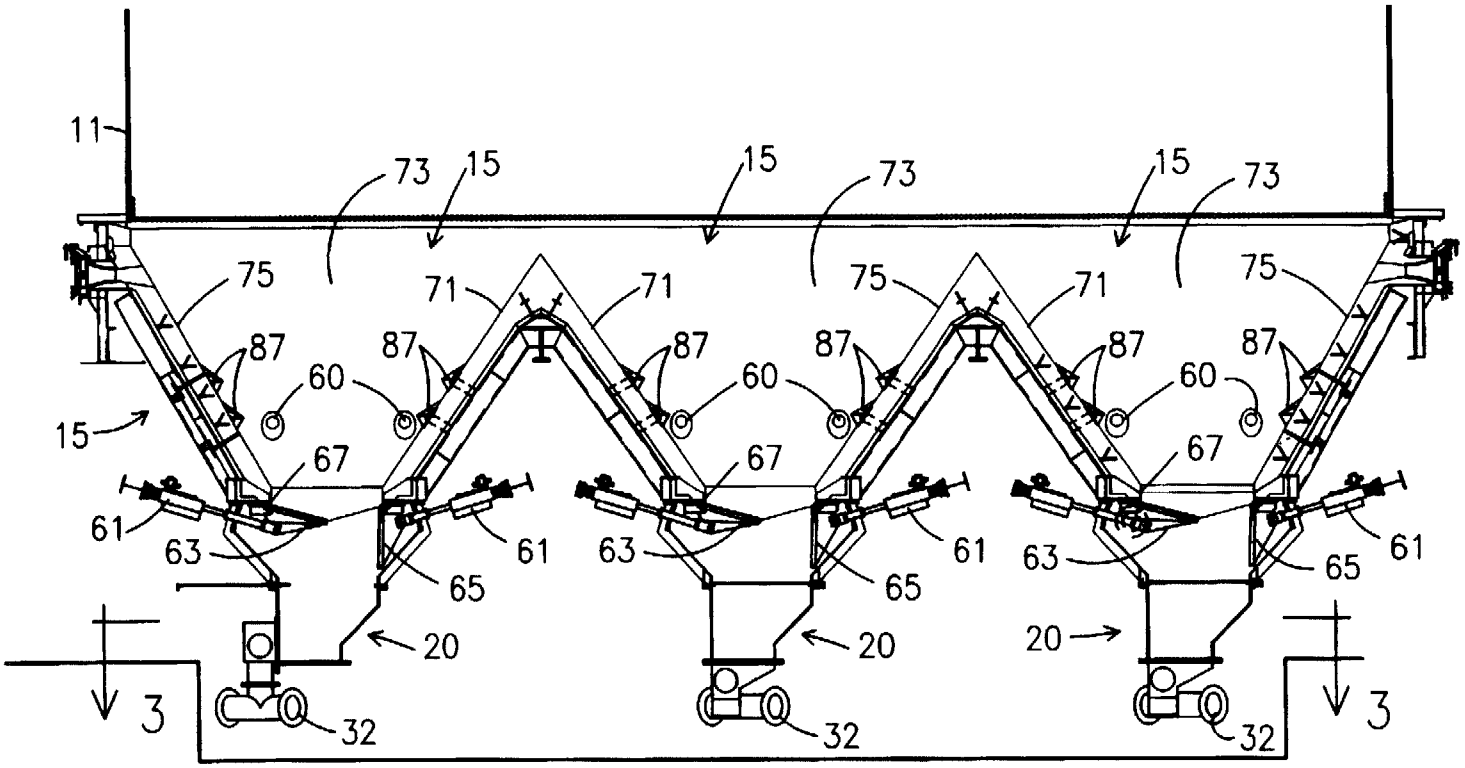
FIG. 2 shows a close-up side view, partially in cross-section, of the hoppers of the present invention.
Figure 4:
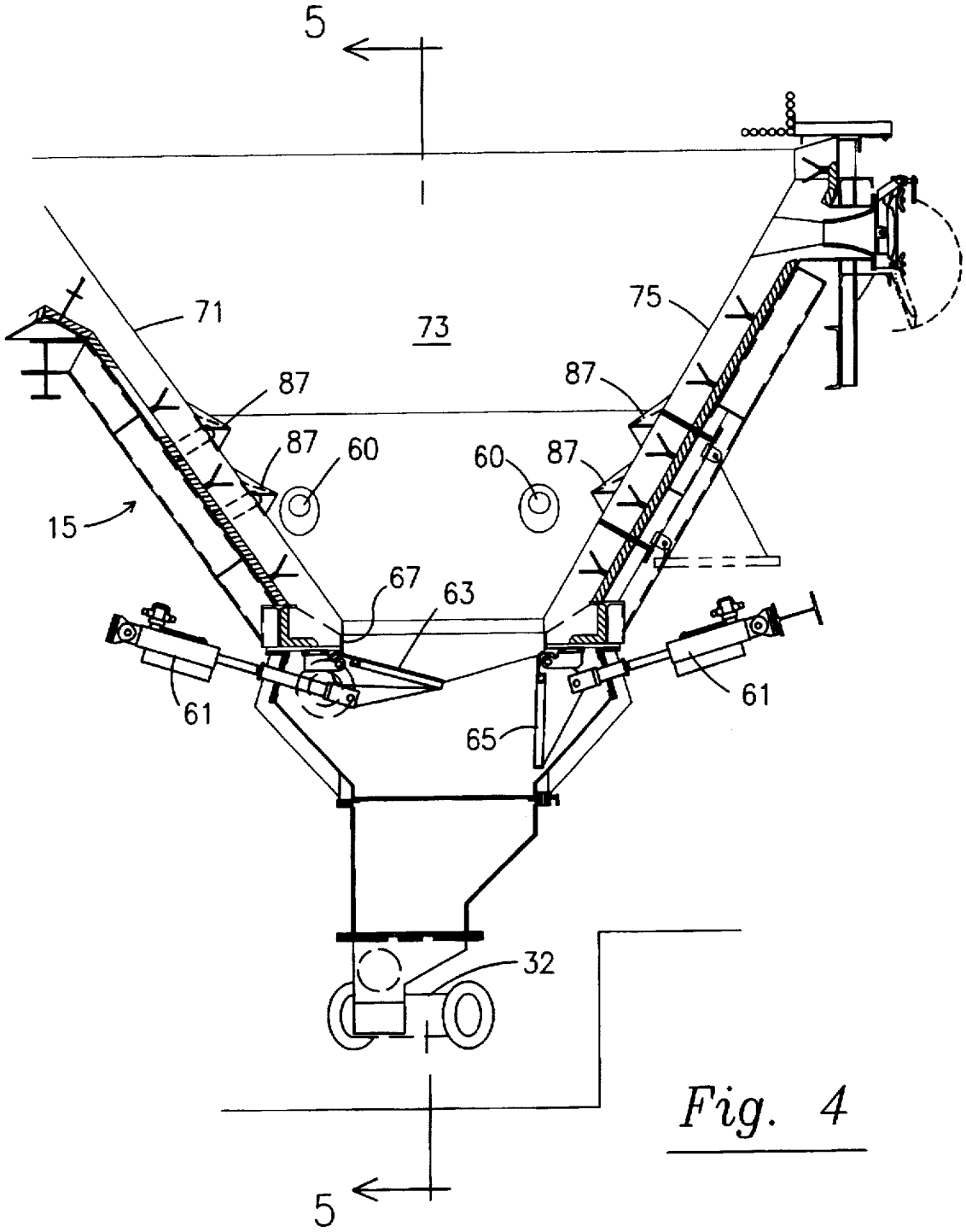
FIG. 4 shows an enlarged cross-sectional view of one hopper in accordance with the teachings of the present invention in the same orientation as the view of FIG. 2.

With further reference to FIG. 1, the vehicle 1 comprises a truck having a preferably generally cylindrical tank 2 mounted on the rear portion thereof, which tank includes a forward surface 4 to which is connected the pipe 41 and pipe 47. In this way, ash entering the tank 2 via the pipe 41 is projected in a rearward direction within the tank 2 so that heavier ash tends to be maintained therein while lighter ash that remains as particulate matter within the air flow tends to exit via the pipe 47, the coupling 45 and the conduit 48 and enters the bottom ash silo 50 after being filtered away from the air stream via the filter element 52 of the filter/separator 49. FIGS. 2 and 4 show the various features of the hoppers 15 in greater detail, including the observation ports 60 and the actuators 61 for the pivotable grate door quarters 63, 65 that control the opening 67.

Figure 3:
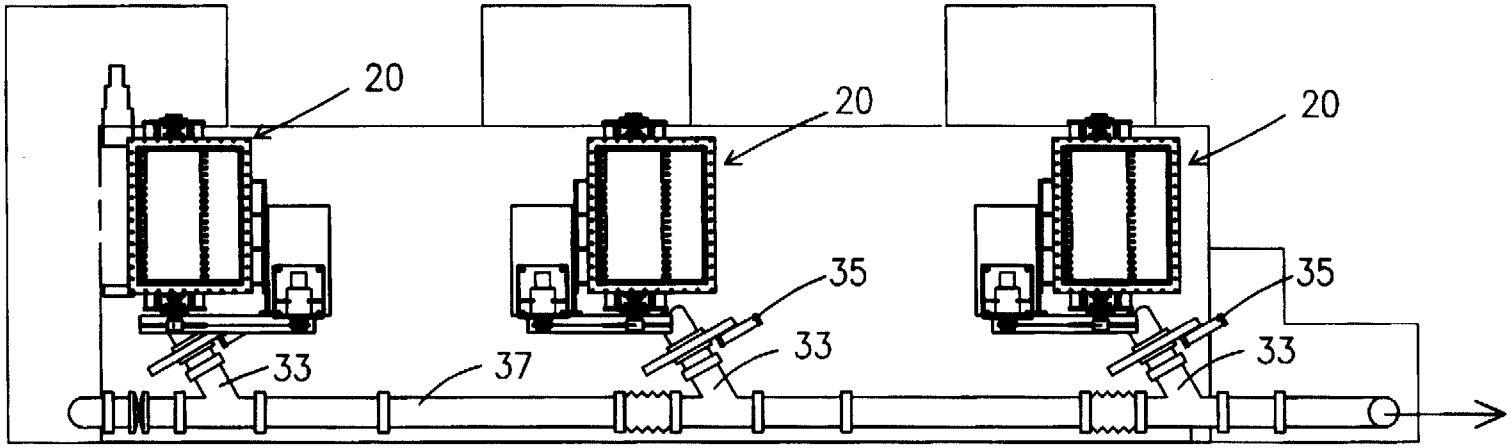
FIG. 3 shows a cross-sectional view along the line 3—3 of FIG. 2.

With reference to FIG. 3, the pneumatic line 37 as well as the feeder lines 33, the valves 35 and the crusher mechanisms 20 are better seen.

Figure 7:
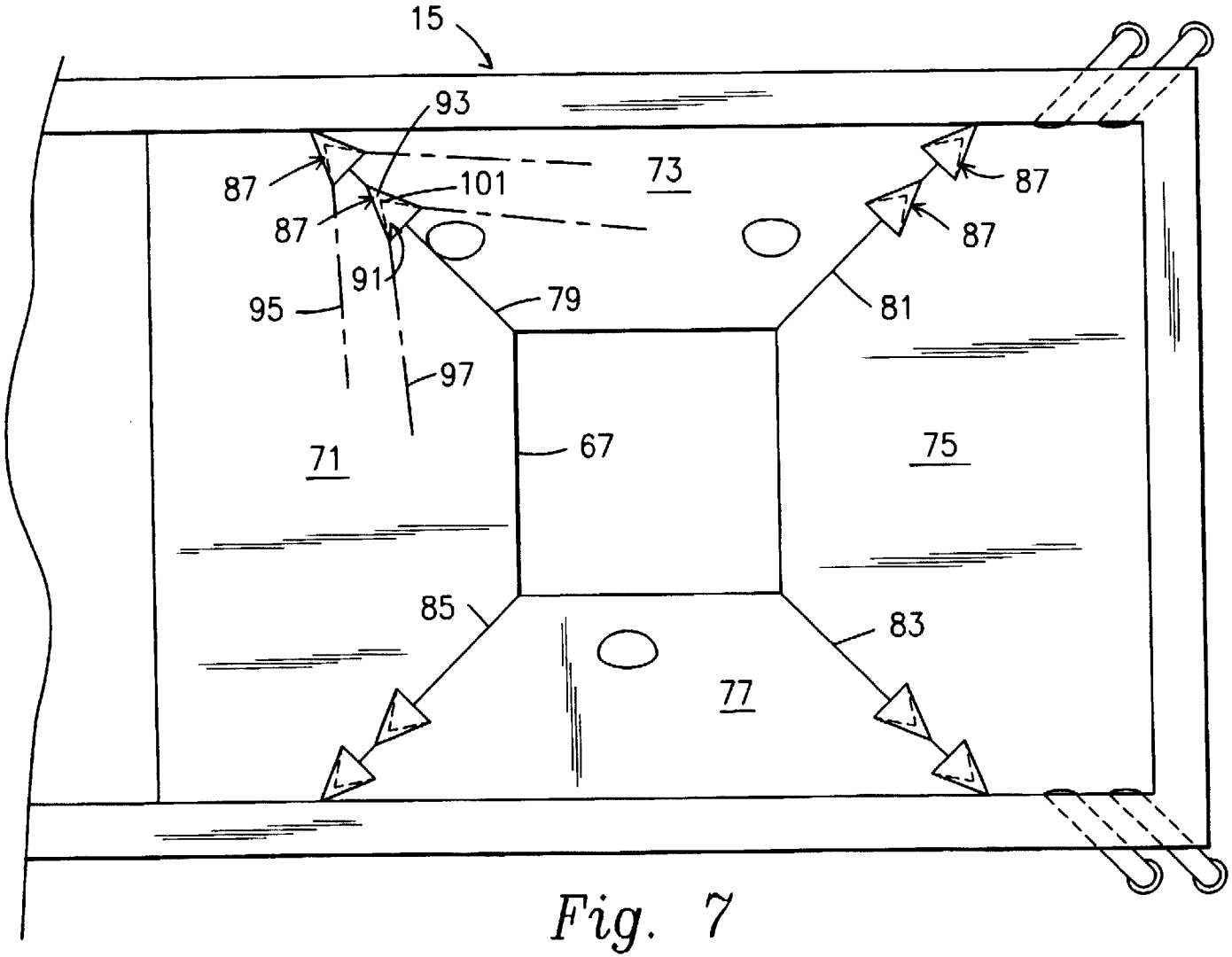
FIG. 7 shows a top view looking downwardly on the hopper of FIGS. 4 and 5.

With reference to FIG. 7, a top view of one of the hoppers is shown. As shown in FIG. 7, the hopper 15 includes four side walls 71, 73, 75 and 77 that converge to the outlet opening 67 that is generally rectangular in configuration. As should be understood from FIG. 7, the seam 79 extends from the outer periphery of the hopper 15 to a corner of the opening 67 between the walls 71 and 73. The seams 81, 83 and 85 are correspondingly configured as seen in FIG. 7.

Figure 5:
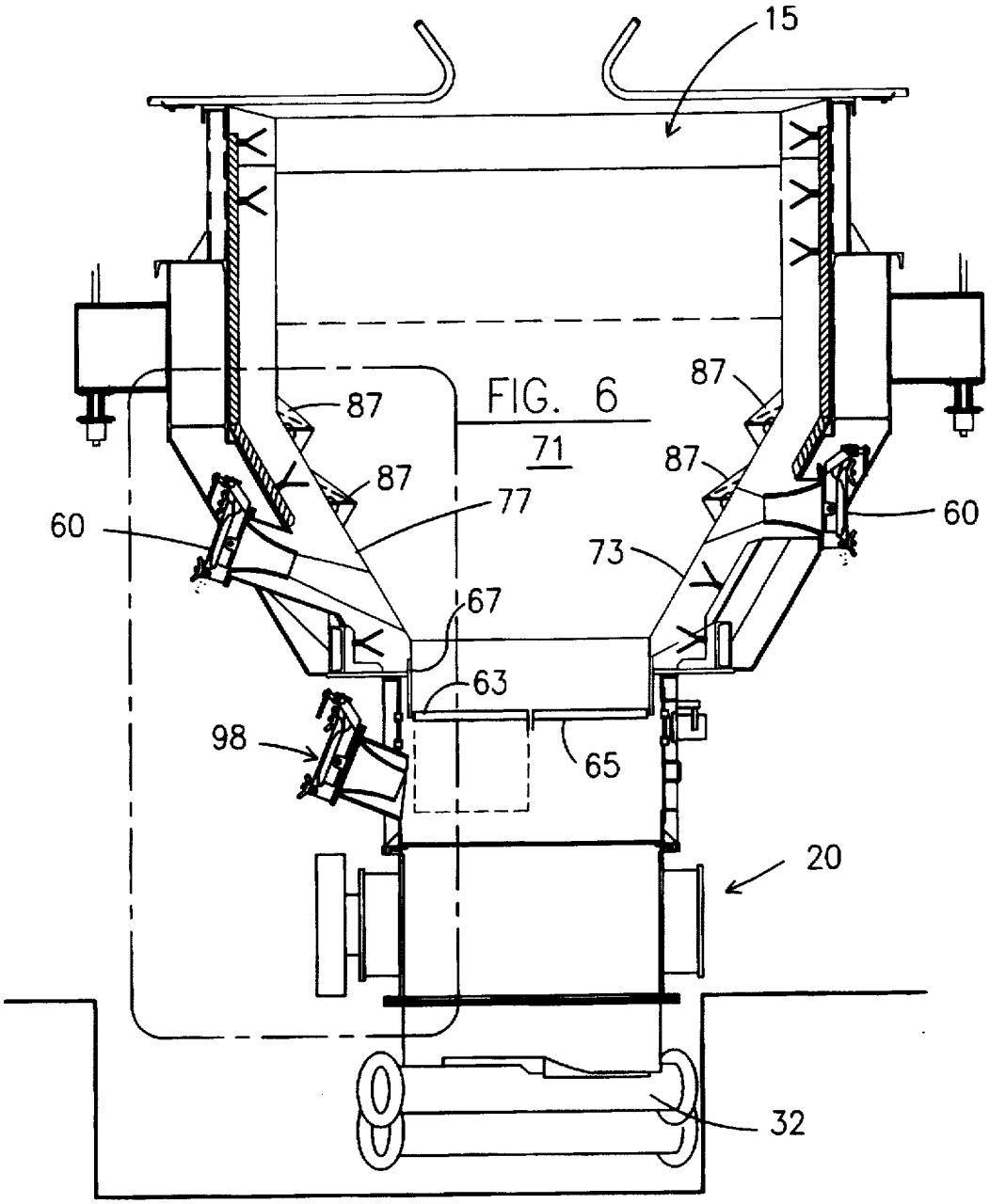
FIG. 5 shows a further cross-sectional view along the line 5—5 of FIG. 4, rotated 90° from the view of FIG. 4.
Figure 6:
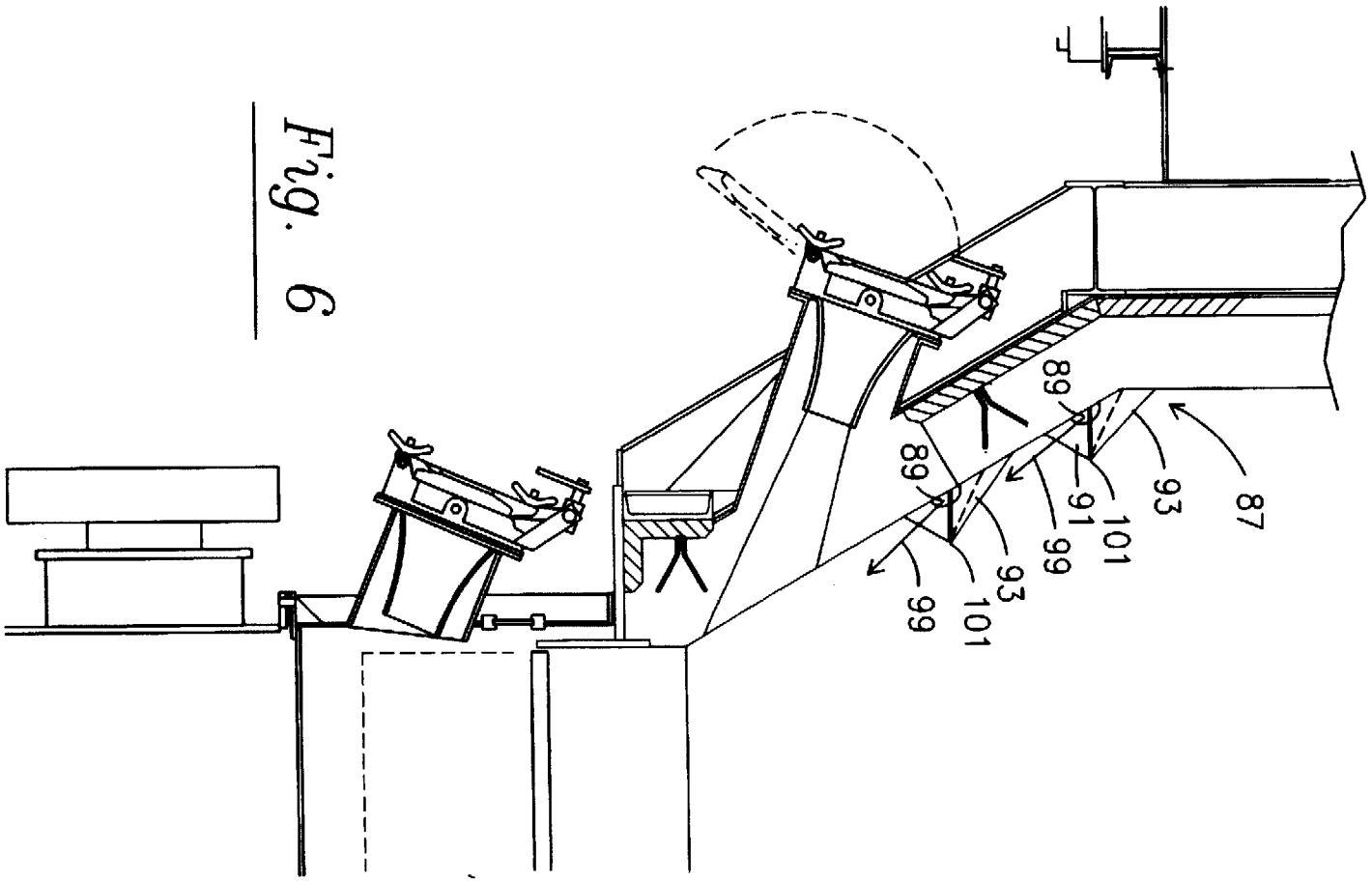
FIG. 6 shows a portion of the cross-section of FIG. 5 but enlarged to show detail.

Each seam has located thereon two air intakes 87 with each air intake having an inlet port 89 extending through the wall of the hopper 15 and an outlet nozzle 91 that diverges from the port 89 in a direction toward the outlet opening 67 of the hopper 15. As best seen with reference to FIGS. 5 and 6, each air intake 87 includes a top wall 93 that extends to a distal termination, the point 101 described hereinabove with reference to FIG. 7. The point 89 comprises the upper apex of the triangular opening of the nozzle 91 as seen in FIGS. 5–7. Referring back to FIG. 7, it should be understood that the flow of air from the ports 89 into the hopper 15 will diverge generally corresponding to the dashed lines 95 and 97 so that any ash adhering to the surfaces of the walls 71, 73, 75 and 77 will tend to be blown toward and through the outlet 67. Flow of pressurized air is depicted by the arrows 99 in FIG. 6. In the preferred embodiment, the air intakes 87 are sequentially fluidly connected to a source of pressurized air (not shown). Each air intake receives air for about thirty seconds. Preferably, every 40–50 minutes, air at a pressure of 10 to 20 psi is pumped through a 3" line to the intakes 87 by a positive displacement blower having a rating of 2700 cubic feet per minute. In the operation of the present invention, the ash is collected in the hoppers 15 beneath the boiler 11. Combustion of unburned fuel within the ash within the storage hopper 15 is continued and promoted through the introduction of air through the ports 89. Additionally, air also is introduced by the fan 27 (FIG. 1) through the gates 63 and 65. The air introduced through the gates 63 and 65 flows through the ash accumulated above to facilitate combustion of fuel products within the ash.

While this operation is taking place, air periodically flowing through the ports 89 also prevents ash from sticking to the walls 71, 73, 75 and 77 of the hopper 15. Thus, air flowing through the ports 89 facilitates flow of ash through the opening 67 and to the crusher 20 of each hopper 15.

Various steps are be taken to control operation of the inventive system 10. Thus, for example, flow of ash from each hopper 15 is controlled sequentially, with only one hopper 15, at a time, being emptied. Additionally, by adjusting the speed of the crusher 20 associated with each hopper 15, control may be effected. When a crusher 20 and screw feeder 32 are feeding material into the pneumatic conveyor line 37, the increased restriction in the line 37 will increase the vacuum force. A vacuum sensing transmitter may be provided within the pneumatic conduit 37 to send a signal to a central controller to reduce the speed of the crusher 20 or momentarily stop it until such time as crushed ash has flowed through the line 37 a sufficient distance to open the line once more. The vacuum transmitter is generally designated by the reference numeral 88 in FIG. 1. The valves 35 serve to isolate the passages 33 from the conveyor line 37. When closed, the air from fan 27 must pass through the grate doors 63 and 65 into the hopper 15. Ash may be conveyed to the conveyor line 37 from a single hopper 15 when a single valve 35 is opened allowing a passage of ash to the conveyor line 37. Ash is conveyed via the pneumatic conveyor line 37 and the coupling 39 to the pipe 41 connected to the front 4 of the tank 2 where ash is conveyed toward the back of the tank 2. The heavier ash particles tend to settle to the bottom of the tank 2 while lighter particles remain entrained within the air in the line 41 will tend to continue onward, exiting the tank 2 via the pipe 47 and the coupling 45, and traveling via the conduit 48 to the filter/separator 49 whereupon air flows out the port 53 and into the conduit 55 while ash is caught by the filter unit 52 and then falls into the bottom ash silo 50. The use of this truck allows higher conveyor capacities and a longer overall pneumatic conveying line.

When the tank 2 is full, the operator of the vehicle 1 may easily uncouple the hoses 41 and 47 from the respective couplings 39 and 45 and may drive the vehicle 1 to a location where the contents of the tank 2 may be suitably discharged.

Accordingly, an invention has been disclosed in terms of a preferred embodiment thereof which fulfills each and every one of the objects of the invention as set forth hereinabove and provides a new and useful dry bottom ash handling system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A hopper for attachment to an underside of a solid fuel-fired boiler, comprising:

a) a plurality of side walls converging from an upper opening to a lower outlet, adjacent side walls having a common seam;

b) each seam having at least one air vent including an inlet port and an outlet nozzle, said nozzle being directed down said seam toward said lower outlet and including nozzle walls that diverge in a direction from said inlet port toward said lower outlet; and c) at least one grate door operable to control flow of ash through said lower outlet.

2. The hopper of claim 1, wherein said plurality of side walls comprises four flat side walls.

3. The hopper of claim 2, wherein said lower outlet is rectangular.

4. The hopper of claim 1, wherein each seam is linear.

5. The hopper of claim 1, wherein each seam has two air vents aligned with one another along each seam.

6. The hopper of claim 1, wherein said at least one grate door comprises four pivotable grate quarters operated by hydraulic actuators.

7. The hopper of claim 1, further including a further air vent located below said grate door.

8. A plurality of hoppers as claimed in claim 1, said hoppers being laterally attached together.

9. A dry bottom ash handling system, comprising a solid fuel-fired boiler having a bottom outlet;

a) a hopper attached to said bottom outlet comprising:

1) a plurality of side walls converging from an upper opening to a lower outlet, adjacent side walls having a common seam;

2) each seam having an air vent including an inlet port and an outlet nozzle, said nozzle being directed down said seam toward said lower outlet and including nozzle walls that diverge in a direction from said inlet port toward said lower outlet; and 3) at least one grate door operable to control flow of ash through said lower outlet;

b) a crusher attached to said lower outlet and having an inlet and an outlet;

c) a pneumatic conveyor fluidly connected to said crusher outlet including a source of vacuum, said pneumatic conveyor conveying ash to a means for disposal of said ash.

10. The dry bottom ash handling system according to claim 9 wherein the means for disposal of said ash is a vehicle mounted tank.

11. The dry bottom ash handling system according to claim 10 wherein said tank includes an inlet port at an upper wall and an outlet port at a forward wall.

12. The dry bottom ash handling system according to claim 11 wherein ash entering said tank travels in a rearward direction with relatively heavier ash particles being retained in said tank and relatively lighter ash particles exiting said tank via said tank outlet port.

13. The system of claim 11, further including a filter connected to said tank outlet port via a conduit, said filter having an inlet side connected to a silo and an outlet side connected to said source of vacuum.

14. The system of claim 11, further including a fluid coupling for coupling said conveyor to said tank.

15. The system of claim 9, including a plurality of adjacent hoppers.

16. The system of claim 9, wherein each hopper seam has at least two air vents aligned with one another along each seam.

17. The system of claim 9, wherein said pneumatic conveyor includes vacuum sensing means for sensing degree of vacuum and control means operable, responsive to sensing of degree of vacuum below a pre-set threshold, to slow down speed of operation of said crusher.

* * * * *